US010170222B2

(12) United States Patent
Lin et al.

(10) Patent No.: US 10,170,222 B2
(45) Date of Patent: Jan. 1, 2019

(54) FITTING WITH A COLLAR FOR A POWER TRANSMISSION SYSTEM

(71) Applicant: MacLean Power, L.L.C., Fort Mill, SC (US)

(72) Inventors: Wei-Chung Lin, Birmingham, AL (US); Bryan Scogin, Moody, AL (US)

(73) Assignee: MacLean Power, L.L.C., Fort Mills, SC (US)

( * ) Notice: Subject to any disclaimer, the term of this patent is extended or adjusted under 35 U.S.C. 154(b) by 0 days.

(21) Appl. No.: 15/710,120

(22) Filed: Sep. 20, 2017

(65) Prior Publication Data

US 2018/0090245 A1 Mar. 29, 2018

Related U.S. Application Data

(60) Provisional application No. 62/398,918, filed on Sep. 23, 2016.

(51) Int. Cl.
*H01B 17/16* (2006.01)
*H01B 17/44* (2006.01)
*H01B 17/04* (2006.01)

(52) U.S. Cl.
CPC ..... *H01B 17/16* (2013.01); *H01B 17/04* (2013.01); *H01B 17/44* (2013.01)

(58) Field of Classification Search
USPC ..... 174/43
See application file for complete search history.

(56) References Cited

U.S. PATENT DOCUMENTS 1,434,565 A * 11/1922 Sessions ..... H01B 17/16 174/163 R
2,007,141 A * 7/1935 Hawley ..... H01B 17/44 174/141 R
3,076,863 A * 2/1963 Lantz ..... H02G 7/20 174/141 R
3,129,279 A * 4/1964 Barton ..... H01R 4/38 174/43
3,250,852 A * 5/1966 Hollander ..... H02G 7/20 174/144
3,614,292 A * 10/1971 Volker ..... H01B 17/00 174/148
3,624,268 A * 11/1971 Otsuki ..... H02G 7/20 174/33
3,670,390 A * 6/1972 Brzoska ..... H02G 1/02 29/247
4,022,431 A * 5/1977 Houston ..... H02G 1/04 254/134.3 PA
4,323,722 A * 4/1982 Winkelman ..... H02G 7/20 174/43
4,531,018 A * 7/1985 Huster ..... H01B 17/46 174/140 R (Continued)

*Primary Examiner* — William H Mayo, III
*Assistant Examiner* — Krystal Robinson
(74) *Attorney, Agent, or Firm* — Brinks Gilson & Lione

(57) ABSTRACT

The present disclosure provides a fitting for a power transmission system. The fitting may include a first end configured to couple to an end of an insulator, a second end configured to couple to a power line, a collar located between the first end and the second end, and a neck located between the collar and the first end. An outer diameter of the collar may be greater than an outer diameter of the neck. A power transmission system with a fitting and corona ring assembly is also provided.

18 Claims, 7 Drawing Sheets

(56) References Cited

U.S. PATENT DOCUMENTS

| | | | | |
|---|---|---|---|---|
| 5,552,566 | A * | 9/1996 | Lin | H01B 17/44<br>174/140 CR |
| 5,834,703 | A * | 11/1998 | Fujii | H01B 17/44<br>174/140 CR |
| 6,265,669 | B1 * | 7/2001 | Richards | H01B 17/42<br>174/140 C |
| 6,455,782 | B1 * | 9/2002 | Lin | H01B 17/44<br>174/127 |
| 7,709,743 | B2 * | 5/2010 | Bernstorf | H01B 17/44<br>174/140 R |
| 2005/0225491 | A1 * | 10/2005 | Martek | H01Q 1/36<br>343/722 |
| 2005/0231210 | A1 * | 10/2005 | Coffeen | G01R 31/1245<br>324/551 |
| 2011/0253421 | A1 * | 10/2011 | Lin | H02G 7/053<br>174/163 R |
| 2015/0249331 | A1 * | 9/2015 | Gottschalk | H01C 7/12<br>361/118 |
| 2015/0304487 | A1 * | 10/2015 | Chaput | H01T 19/02<br>248/550 |
| 2018/0090245 | A1 * | 3/2018 | Lin | H01B 17/16 |

* cited by examiner

FITTING WITH A COLLAR FOR A POWER TRANSMISSION SYSTEM

CROSS-REFERENCE TO RELATED APPLICATIONS

This application claims priority to U.S. Provisional Patent Application Ser. No. 62/398,918, entitled "FITTING WITH A COLLAR FOR A POWER TRANSMISSION SYSTEM," and filed Sep. 23, 2016, which is incorporated by reference herein in its entirety.

BACKGROUND

In high-voltage transmission power lines, corona and radio interference are typical phenomena acting on the power line hardware. Corona, which is an electrical discharge brought on by the ionization of a fluid (e.g., air) surrounding an electrically-charged conductor, generally occurs when the electric field around a conductor is high enough to form a conductive region, but not high enough to cause electrical breakdown or arcing to nearby objects. Radio interference (also called electromagnetic interference) is the conduction or radiation of a radio frequency energy that may disrupt or interfere with electromagnetic waves of the same wavelength. If not controlled, it poses serious electromagnetic interference to the system and its vicinity.

In a typical power transmission system with suspended power lines, hardware is included to suspend the conductor in the air and an insulator to insulate the conductor from the transmission tower (which may include a pole or a lattice tower, for example). The insulator is generally made of porcelain, glass, or another suitable material such as a composite polymer. The hardware supporting the insulator and coupling the insulator to the transmission power lines is typically made of aluminum, iron, or steel.

One or more corona rings (which may also be called anti-corona rings) may be included at or near the end of the insulator closest to the transmission power lines. The corona rings may, when exposed to a high voltage, distribute the electric field gradient such that the maximum of the electric field gradient is lowered, for example to a level below the corona threshold to prevent corona discharge. The corona rings may prevent electrical overstress in the insulating materials and may prevent deterioration of the insulating materials over time.

One disadvantage of currently-known hardware coupling or otherwise securing the insulator to a corona ring is the ability of the corona ring to be installed upside-down or in another improper orientation by an inexperienced technician. The improper installation of a corona ring may limit its effectiveness and cause the insulator to become electrically overstressed and/or cause the insulative materials to deteriorate over time.

BRIEF SUMMARY

In one general aspect, the present disclosure provides a fitting for a power transmission system. The fitting may include a first end configured to couple to an end of an insulator, a second end configured to couple to a power line, a collar located between the first end and the second end, and a neck located between the collar and the first end. An outer diameter of the collar may be greater than an outer diameter of the neck.

The collar may include a notch adjacent to the neck. The notch may include a diameter being greater than the outer diameter of the neck, and the diameter of the notch may be less than the outer diameter of the collar.

The collar may be configured to couple to a socket of a corona ring. The collar may include an oblate spheroid. At least one grip element may be configured such that it can tighten around the collar of the fitting to secure the fitting with respect to the corona ring assembly.

The first end of the fitting may include a socket eye configured to receive an end of the insulator. The second end of the fitting may have a Y-clevis configured to attach to a yoke plate, and the yoke plate may be coupled to the power line.

In another general aspect, the present disclosure provides a system for supporting at least one transmission power line. The system may include a fitting having a first end configured to couple to an end of an insulator, a second end configured to couple to a power line, a collar located between the first end and the second end, and a neck located between the collar and the first end. The system may further include a corona ring assembly having a corona ring, a clamp seat coupled to the corona ring, and at least one grip element, where the clamp seat and the at least one grip element form a socket for receiving the collar of the fitting.

The collar may include a first side and a second side, the first side having a notch, and the notch being adjacent to the neck. The at least one grip element may include a first diameter for receiving the first side of the collar. The clamp seat may have a receiving channel with a second diameter for receiving the second side of the collar. The first diameter may be larger than the second diameter. The first diameter may be larger than a diameter of the notch, and the second diameter may be smaller than the diameter of the notch. The first diameter and the second diameter may be smaller than a maximum diameter of the collar.

The notch may include a diameter being greater than an outer diameter of the neck, and the diameter of the notch may be less than an outer diameter of the collar. The collar may include an oblate spheroid. The at least one grip element may include a first grip element and a second grip element that are pivotally mounted to the clamp seat.

The first end of the fitting may include a socket eye configured to receive an end of the insulator. The second end of the fitting may include a Y-clevis configured to attach to a yoke plate. The system may include a second fitting and a yoke plate, where the first fitting and the second fitting are coupled to the yoke plate in a V configuration.

DETAILED DESCRIPTION

The present embodiments may be better understood with reference to the following drawings and description. The components in the figures are not necessarily to scale, emphasis instead being placed upon illustrating certain principles.

Figure 1:
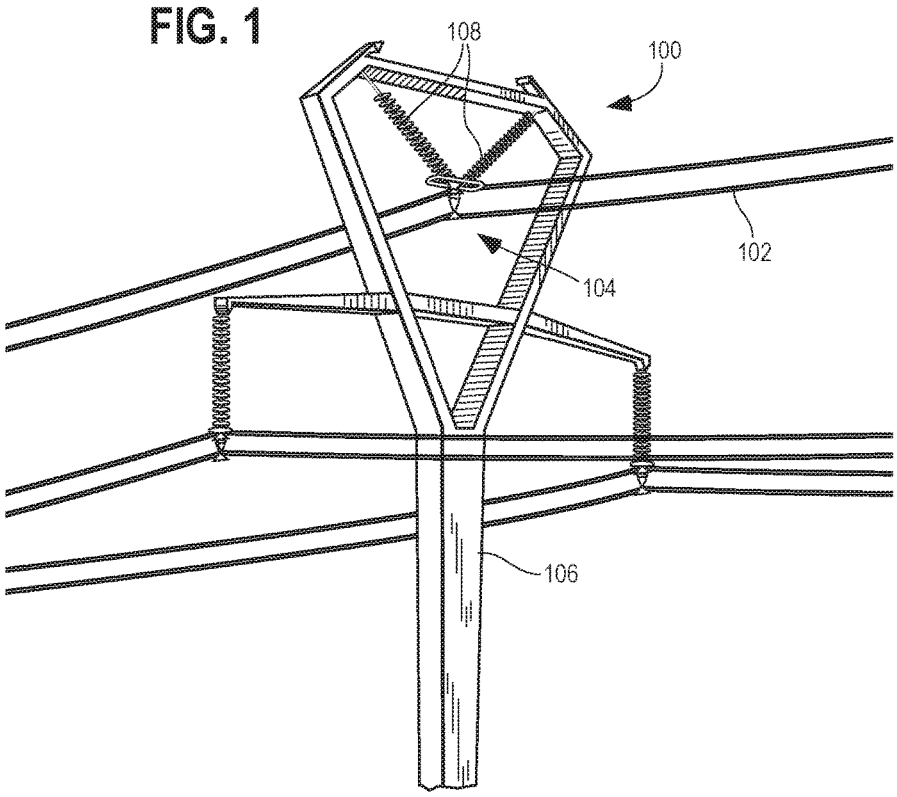
FIG. 1 shows a system for supporting one or more transmission power lines in accordance with the present disclosure.

FIG. 1 shows a perspective view of a power transmission system 100 with several power lines 102. A support system 104 may couple the transmission power lines 102 to a transmission tower 106 (which may include a pole, a lattice tower, etc.). An insulator 108 (which may refer to an assembly of a plurality of insulative plates and other components associated with a suspension line) may be located between the support system 104 and the transmission tower 106 to provide suitable electrical insulation between the electrically-charged conductors of the transmission power lines 102 and the transmission tower 106. As shown, the insulator 108 may form and/or may be attached to a suspension line that may suspend the support system 104 and the transmission power lines 102. The insulator 108 may include a series of insulative plates, which may be made of glass, porcelain, or another suitable material, such as a composite polymer material. The insulative plates may be precisely located for optimal insulation and may be precisely located a particular distance from the hardware of the support system 104. The insulative plates are typically manufactured in accordance with certain industry standards (e.g., ANSI C29.1 to C29.10).

Figure 2A:
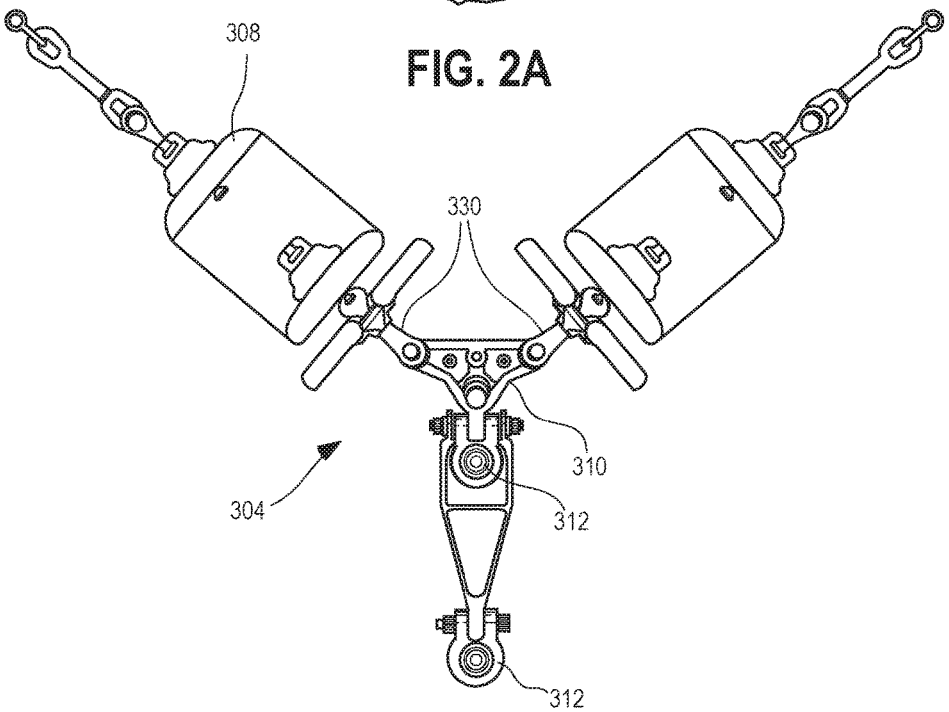
FIG. 2A and FIG. 2B show an embodiment of a support system with a fitting for coupling to a power line insulator in accordance with the present disclosure.
Figure 2B:
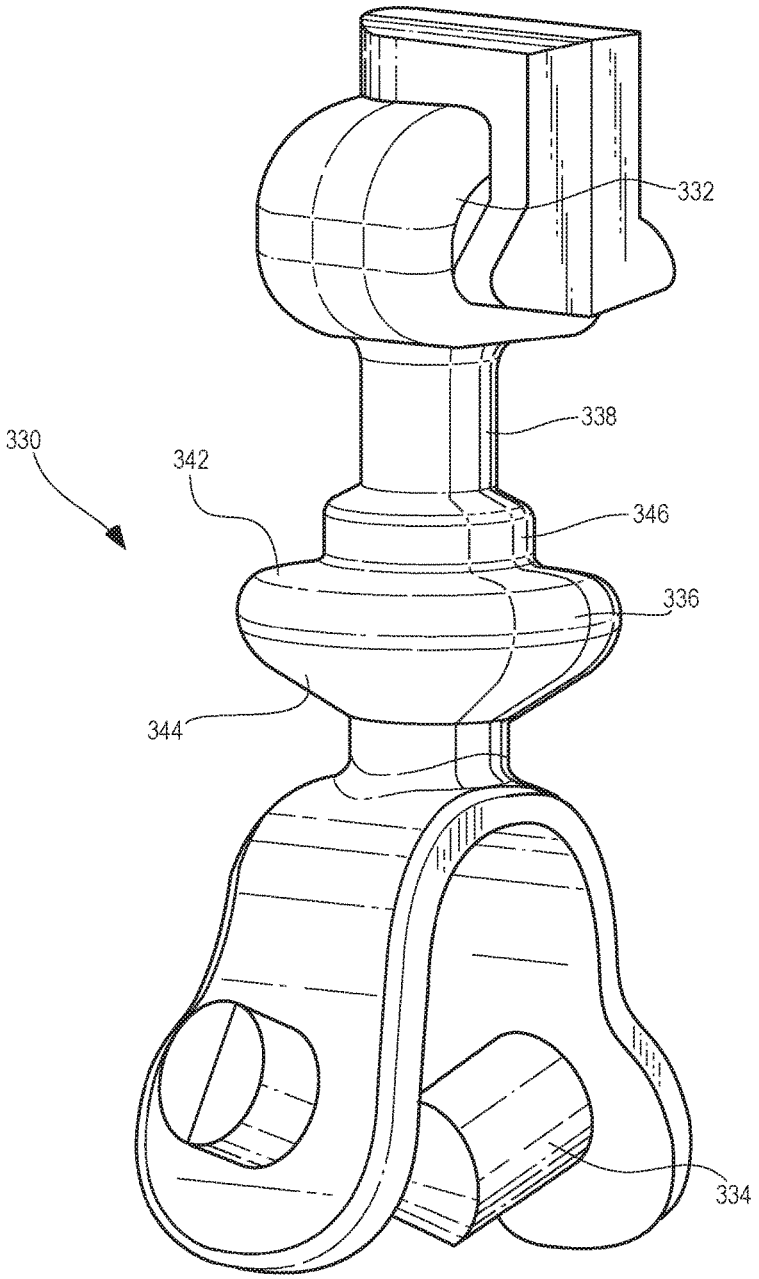

Referring to FIG. 2A and FIG. 2B, one or more fittings 330 may be included in a support system 304 (which may be similar to the support system 104 of FIG. 1). The support system 304 may be oriented to form a V-configuration with two fittings 330 coupled to the two respective insulators 308, as shown (which may be glass or porcelain insulators). The fittings 330 may be located between a yoke plate 310 and the insulators 308. A first end 332 of each fitting 330 may be configured to couple to the insulator 308, and an opposite end of the insulator 308 may be coupled to a transmission tower (not shown). In some embodiments, the first end 332 may include a socket eye (shown in FIG. 7) which may be designed to receive an end of an insulator 308 to secure the insulator 308 to the fitting 330. In some embodiments, the insulator 308 may include a plurality of insulative plates and other components associated with a suspension line, for example. The fittings 330 may further include a second end 334 configured to couple indirectly or directly power line (e.g., through the yoke plate 310). For example, the second end 334 may have a Y-clevis or other suitable structure for connecting to the yoke plate 310, and the yoke plate 310 may be connected to the depicted power line supports 312 (shown as clamps), which may hold a power line.

As shown in FIG. 2B, a collar 336 may be located between the first end 332 and the second end 334 of the fitting 330, and a neck 338 may be located between the collar 336 and the first end 332. The collar 336 may be shaped substantially as an oblate spheroid (as shown), though any other suitable shape may be used (e.g., a cylinder, a disk, a sphere, etc.). An outer diameter of the collar 336 (which may be the maximum outer diameter of the oblate spheroid in this example) may be greater than an outer diameter of the neck 338. For example, in one non-limiting embodiment, the maximum outer diameter of the oblate spheroid may be from about ½ inch to about 6 inches, such as from about 2 inches to about 3 inches. The outer diameter of the neck 338 may be from about ¼ inch to about 4 inches, such as from about ⅝ inch to about 1½ inches. The collar 336 may be configured (e.g., sized and shaped) to be received by a socket of a corona ring assembly as described in more detail below.

The collar 336 may include a first side 342 and an opposite second side 344. The first side may be located adjacent to the neck 338. As depicted, the first side 342 of the collar 336 may include a notch 346. The notch 346 may be generally cylindrical in shape (although it is not limited to this shape), and may have a maximum diameter that is smaller than the maximum outer diameter of the collar 336 but larger than the maximum diameter of the neck 338. The notch 346 may further extend a distance (which may be referred to herein as its "height") from the oblate spheroid or other shape of the collar 336. The height of the notch 346 may be from about 1/32 inch to about 3 inches, such as from about ⅛ inch to about 1 inch.

Figure 3A:
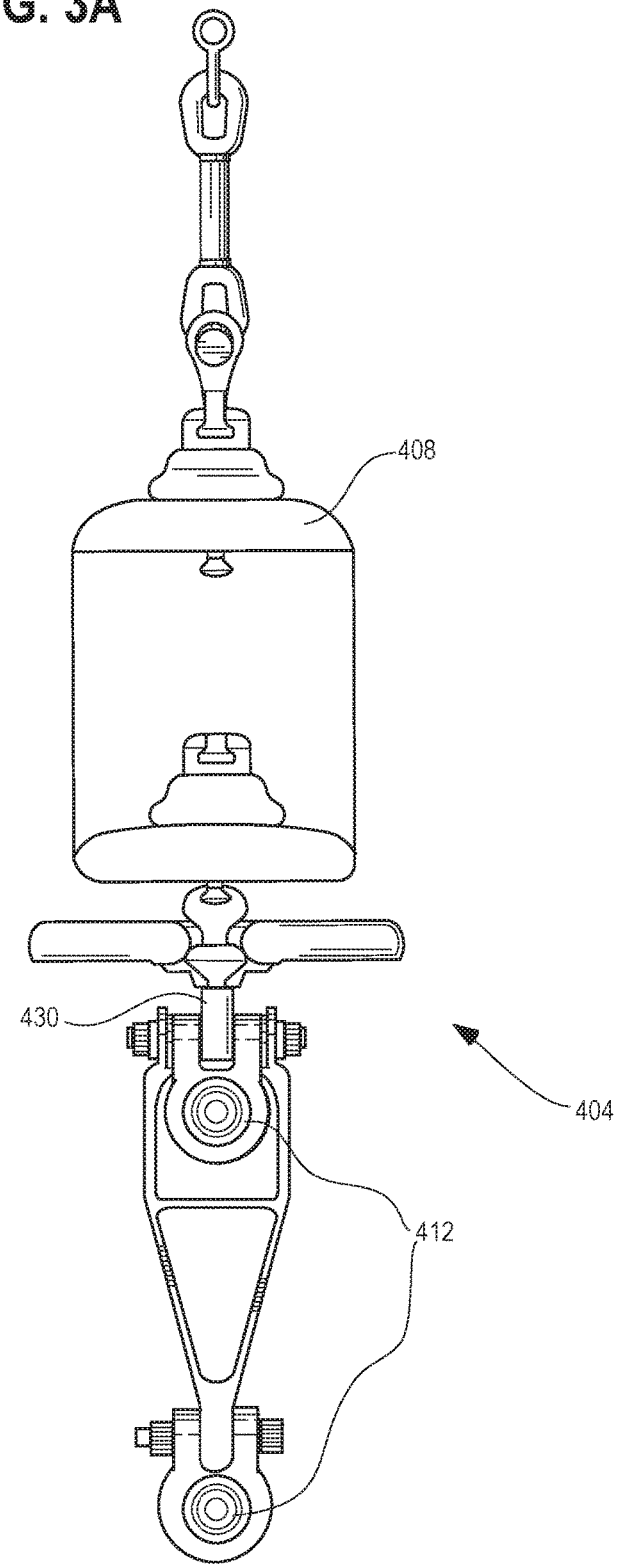
FIG. 3A and FIG. 3B show a second embodiment of a fitting for coupling to a power line insulator in accordance with the present disclosure.
Figure 3B:
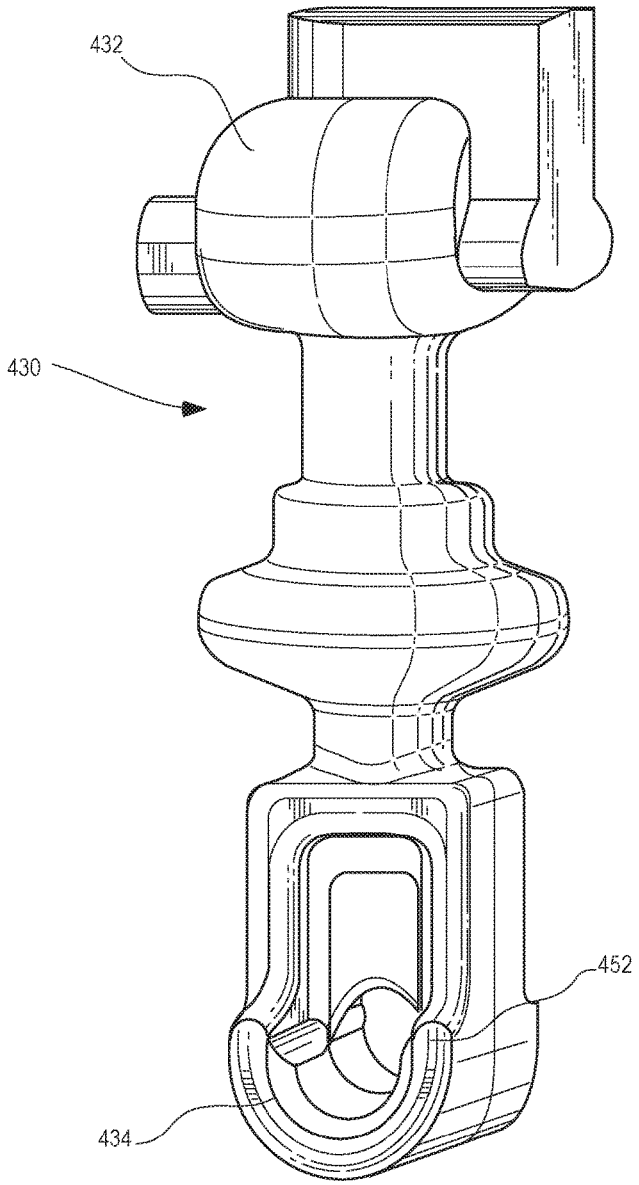

FIG. 3A and FIG. 3B show a support system 404 with a fitting 430 similar to the fitting 330 of FIG. 2A and FIG. 2B but in an I-configuration (e.g., having one fitting 430 coupled to a single insulator 408, such as a glass or porcelain insulator) and having a different second end 434. Referring to FIG. 3B, the second end 434 of the fitting 430 includes a socket eye 452 configured to couple directly to a power line support 412 (here depicted as a clamp) without a yoke plate. It is contemplated that the second end 434 of the fitting 430 could include any other suitable connection structure. Similarly, the first end 432 of the fitting 430 may include any suitable connection structure for coupling directly or indirectly to a power line insulator 408 (which may include a suspension line and a plurality of insulative plates).

Figure 4:
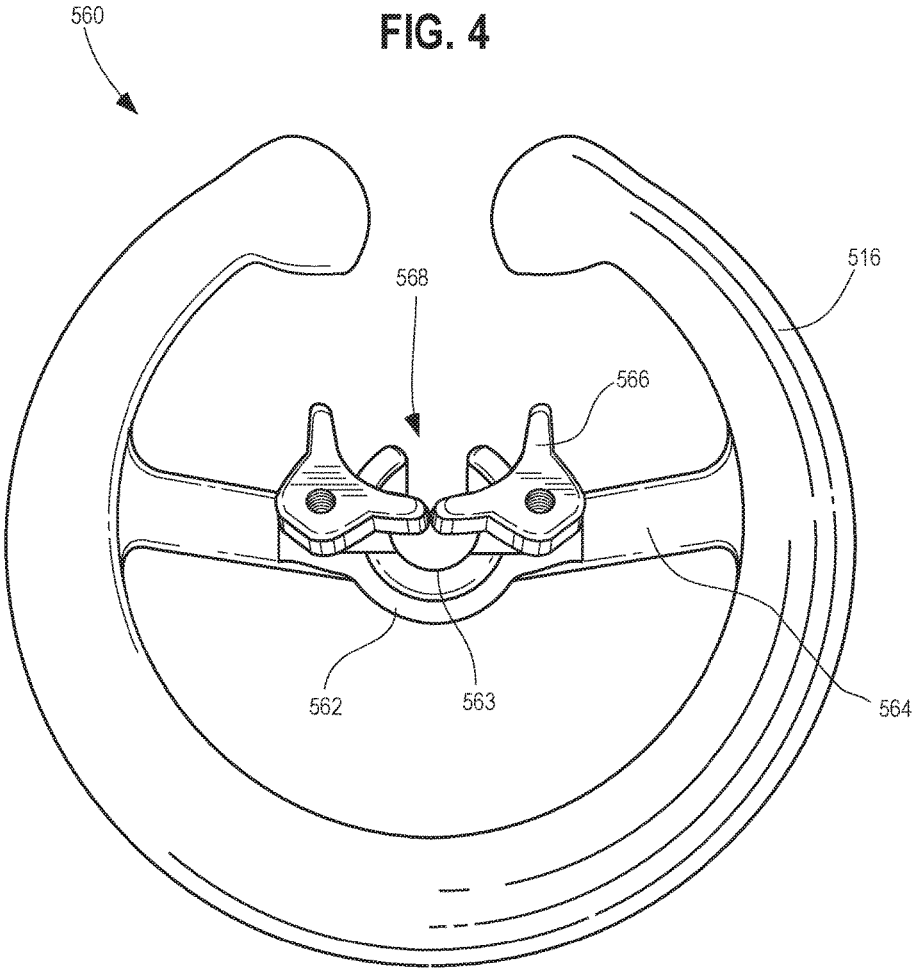
FIG. 4 shows a corona ring assembly hat may be used with a fitting for coupling to a power line insulator in accordance with the present disclosure.

FIG. 4 shows a corona ring assembly 560. The corona ring assembly 560 may include a corona ring 516, a clamp seat 562, and at least one frame member 564 coupling the corona ring 516 to the clamp seat 562. The corona ring assembly 560 may further include at least one grip element, such as the depicted grip elements 566. The grip elements 566 may be pivotally mounted near the clamp seat 562 and configured to secure a collar of a fitting to the corona ring assembly 560 such that combination of the one or more grip elements 566 and the clamp seat 562 form a socket 568 for receiving the fitting (e.g., the fitting 430 of FIG. 3A and FIG. 3B and/or the fitting 330 of FIG. 2A and FIG. 2B).

Figure 5:
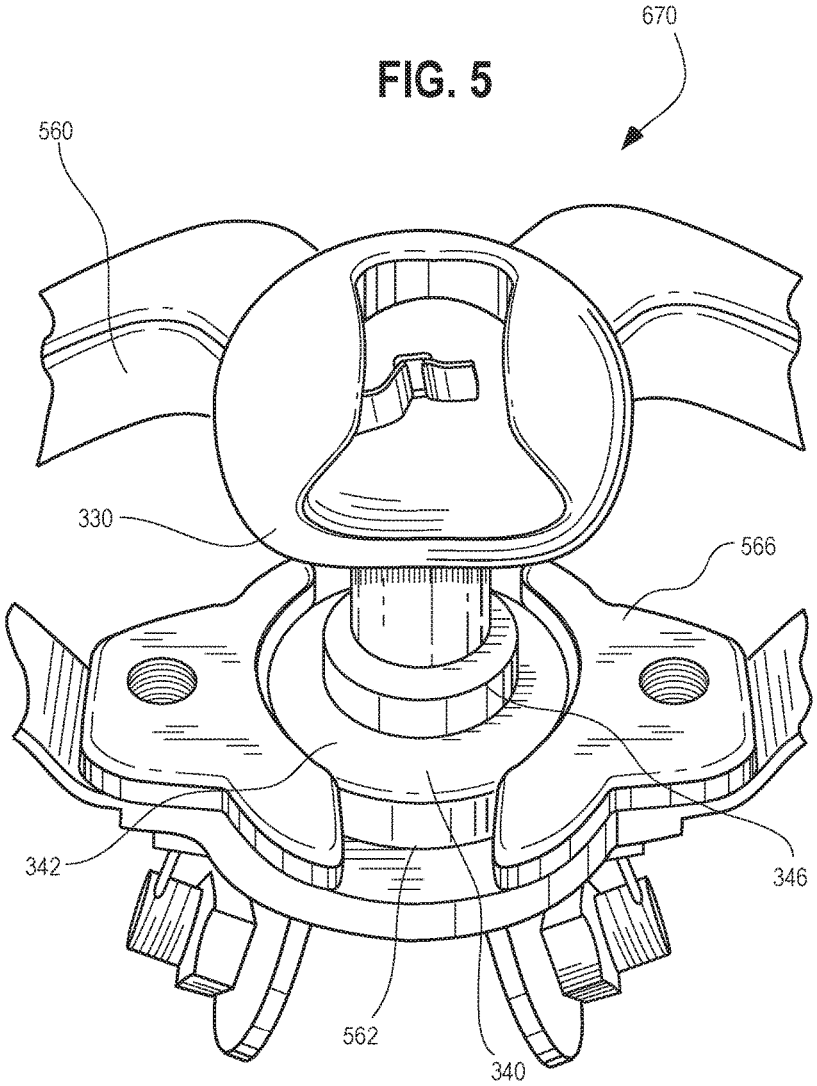
FIG. 5 shows a system in accordance with the present disclosure, the system including the fitting of FIG. 2A and FIG. 2B and the corona ring assembly of FIG. 4.

FIG. 5 shows the fitting 330 (shown alone in FIG. 2B) coupled to the corona ring assembly 560 (shown alone in FIG. 4), which together form at least a portion of a power line support system 670. The first side 342 of the collar 340 may be received by the clamp seat 562. For example, the receiving channel 563 (shown in FIG. 4) may be configured (e.g., sized and shaped) such that the second side 344 (hidden in FIG. 5) of the collar rests on an edge of the receiving channel 563 when the collar 340 is properly placed in the socket 568. Similarly, each of the grip elements 566 may have edges that abut the collar 340, as shown. The grip elements 566 may be tightened around the collar 340 (e.g., by turning screws coupled to the grip elements 566 and the clamp seat 562 in a certain direction and/or by using another suitable tightening mechanism) to secure the collar 340 within the socket 568. As shown, the maximum outer diameter of the collar 340 may be larger than the diameter of the receiving channel 563 (hidden) and the diameter formed by the grip elements 566 such that when the grip elements 566 are tightened, the collar 340 is suitably secured within the socket. The diameter formed by the grip elements 566 may be greater than the diameter of the notch 346 such that the notch 346 does not impede the abutment of the grip elements 566 and the first side 342 of the collar 340.

Figure 6:
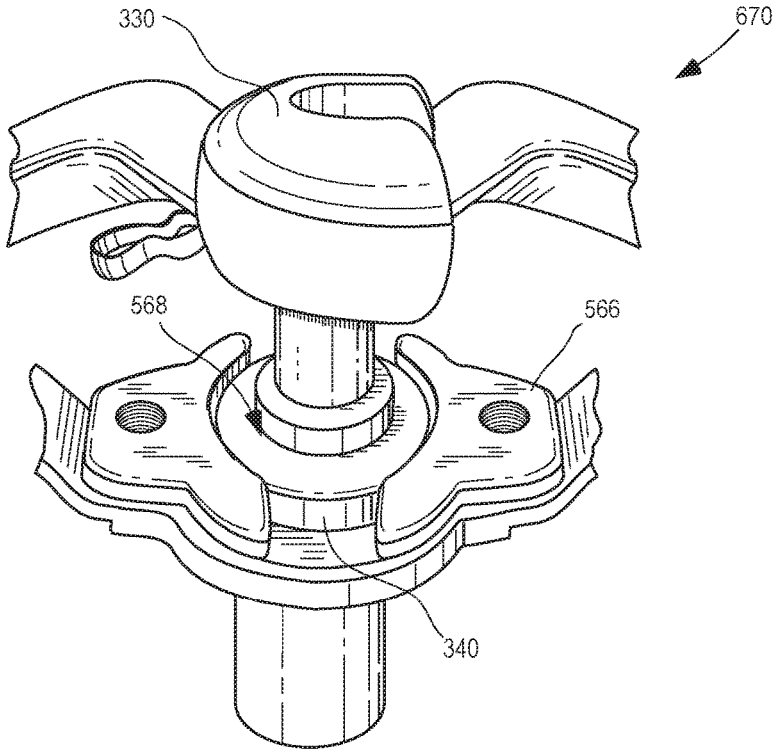
FIG. 6 shows the system depicted in FIG. 5 where the fitting has been rotated ninety (90) degrees.

FIG. 6 shows the power line support system 670 depicted in FIG. 5 where the fitting 330 has been rotated ninety (90) degrees. It is contemplated that the collar 340 of the fitting 330 may be rotatable within the socket 568 prior to the grip elements 566 being fully tightened such that an operator can properly orient various components during installation and/or maintenance. The collar 340 may be fixed within the socket 568 when the grip elements 566 are tightened a suitable amount. Alternatively, it is contemplated that the collar 340 may remain rotatable within the socket 568 even after installation, which may be advantageous for allowing various components to self-adjust due to environmental conditions (e.g., wind).

Figure 7:
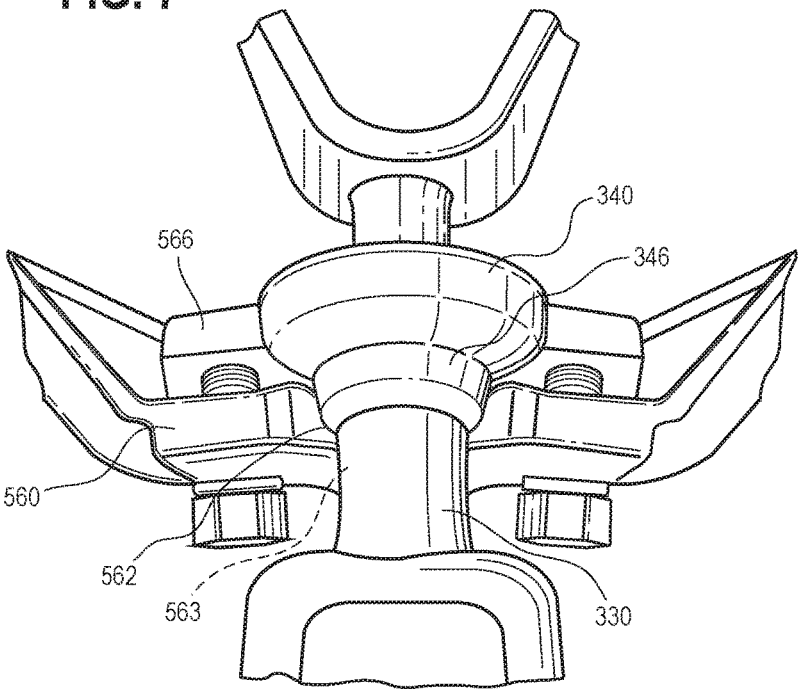
FIG. 7 shows the result of an attempt to couple the fitting of FIG. 2A and FIG. 2B in an improper orientation with respect to the corona ring assembly of FIG. 4.

FIG. 7 shows the result of an improper attempt to couple the fitting 330 with the corona ring assembly 560 (i.e., the fitting 330 is upside-down with respect to its proper orientation). As shown, the notch 346 of the collar 340 may have a diameter that is larger than the diameter of the clamp seat 562. Accordingly, the notch 346 prevents the first side of the collar 340 from properly resting within the clamp seat 562. In the depicted orientation, the height of the notch 346 may be sufficiently large such that the portion of the collar 340 (which, as described above, may have an oblate spheroid shape) that is adjacent to the grip elements 566 may have a diameter too large for the grip elements 566 to receive. Thus, it may be exceedingly difficult or impossible for a technician to tighten the grip elements 566 around the collar 340 when the fitting 330 is upside-down.

The embodiments of the fitting described herein may be advantageous at least for ensuring that a corona ring is installed in the correct orientation with respect to other components associated with transmission lines, which may reduce technician exposure to dangerous conditions and provide high effectiveness the power transmission system. The described fittings may additionally ensure proper spacing between the insulator, the corona ring, and/or the associated electrically-charged hardware. These embodiments may also be provide simple, efficient, and effective installation and/or maintenance and may be relatively simple to manufacture. Further, the durability and longevity of the embodiments described herein may exceed those of previously-known systems.

With respect to the embodiments described herein, it will be understood by those skilled in the art that various changes in form and details may be made therein without departing from the spirit and scope of the invention as defined by the appended claims.

We claim:

1. A fitting for a power transmission system, the fitting comprising:

a first end for coupling to an end of an insulator;

a second end opposite the first end, the second end configured to couple to a power line;

a collar located between the first end and the second end; and a neck located between the collar and the first end, wherein an outer diameter of the collar is greater than an outer diameter of the neck, and wherein the collar includes a notch located adjacent to the neck, the notch having a diameter being greater than the outer diameter of the neck, and the diameter of the notch being less than the outer diameter of the collar such that the notch prevents upside-down installation of a corona ring.

2. The fitting of claim 1, wherein the collar is configured to couple to a socket of the corona ring.

3. The fitting of claim 1, wherein the collar includes an oblate spheroid.

4. The fitting of claim 1, wherein the first end includes a socket eye configured to receive an end of the insulator.

5. The fitting of claim 1, wherein the second end includes a Y-clevis configured to attach to a yoke plate, the yoke plate being coupled to the power line.

6. A system for supporting at least one transmission power line, the system comprising:

a fitting having a first end configured to couple to an end of an insulator, a second end configured to couple to a power line, a collar located between the first end and the second end, and a neck located between the collar and the first end; and a corona ring assembly having a corona ring, a clamp seat coupled to the corona ring, and at least one grip element, wherein the clamp seat and the at least one grip element form a socket for receiving the collar of the fitting.

7. The system of claim 6, wherein the at least one grip element is configured such that it can tighten around the collar of the fitting to secure the fitting with respect to the corona ring assembly.

8. The system of claim 6, wherein the collar includes a first side and a second side, the first side having a notch, and the notch being adjacent to the neck.

9. The system of claim 8, wherein the at least one grip element includes a first diameter for receiving the first side of the collar, and wherein the clamp seat has a receiving channel with a second diameter for receiving the second side of the collar.

10. The system of claim 9, wherein the first diameter is larger than a diameter of the notch, and wherein the second diameter is smaller than the diameter of the notch.

11. The system of claim 9, wherein the first diameter and the second diameter are smaller than a maximum diameter of the collar.

12. The system of claim 9, wherein the first diameter is larger than the second diameter.

13. The system of claim 8, wherein the notch includes a diameter being greater than an outer diameter of the neck, and the diameter of the notch being less than an outer diameter of the collar.

14. The system of claim 6, wherein the collar includes an oblate spheroid.

15. The system of claim 6, wherein the at least one grip element includes a first grip element and a second grip element that are pivotally mounted to the clamp seat.

16. The system of claim 6, wherein the first end includes a socket eye configured to receive an end of the insulator.

17. The system of claim 6, wherein the second end includes a Y-clevis configured to attach to a yoke plate.

18. The system of claim 6, further comprising a second fitting and a yoke plate, wherein the fitting and the second fitting are coupled to the yoke plate in a V configuration.

* * * * *